US011332897B2

(12) United States Patent
Miller et al.

(10) Patent No.: US 11,332,897 B2
(45) Date of Patent: May 17, 2022

(54) BRIDGE SUPPORT SYSTEM

(71) Applicants: Blaine Miller, Embden, ME (US); Steven C. Govoni, Skowhegan, ME (US)

(72) Inventors: Blaine Miller, Embden, ME (US); Steven C. Govoni, Skowhegan, ME (US)

( * ) Notice: Subject to any disclaimer, the term of this patent is extended or adjusted under 35 U.S.C. 154(b) by 0 days.

(21) Appl. No.: 17/326,658

(22) Filed: May 21, 2021

(65) Prior Publication Data

US 2021/0363710 A1 Nov. 25, 2021

Related U.S. Application Data

(60) Provisional application No. 63/028,200, filed on May 21, 2020.

(51) Int. Cl.

| | |
|---|---|
| ***E01D 19/02*** | (2006.01) |
| ***E01D 19/04*** | (2006.01) |
| *E01D 101/26* | (2006.01) |

(52) U.S. Cl.

CPC ..... *E01D 19/02* (2013.01); *E01D 19/041* (2013.01); *E01D 2101/26* (2013.01)

(58) Field of Classification Search

CPC .... E01D 19/02; E01D 19/041; E01D 2101/26
See application file for complete search history.

(56) References Cited

U.S. PATENT DOCUMENTS

| | | | | |
|---|---|---|---|---|
| 4,051,570 | A * | 10/1977 | Hilfiker | E01D 2/00 14/26 |
| 4,713,917 | A * | 12/1987 | Buckle | E01D 19/041 248/565 |
| 5,771,518 | A * | 6/1998 | Roberts | E01D 19/02 14/73.1 |
| 8,341,788 | B2 * | 1/2013 | Kim | E01D 19/00 14/77.3 |
| 9,873,995 | B1 * | 1/2018 | Chen | E01D 19/02 |
| 10,914,043 | B1 * | 2/2021 | Liu | G01M 5/0025 |
| 2003/0061672 | A1 * | 4/2003 | Eustace | E01D 21/00 14/77.1 |
| 2008/0196341 | A1 * | 8/2008 | Kang | E01D 19/02 52/292 |
| 2016/0265212 | A1 * | 9/2016 | Sung | E01D 19/02 |
| 2017/0356144 | A1 * | 12/2017 | Fu | E01D 21/00 |
| 2018/0202878 | A1 * | 7/2018 | Yu | B32B 7/08 |
| 2019/0161925 | A1 * | 5/2019 | Cousin | E01D 22/00 |

* cited by examiner

*Primary Examiner* — Abigail A Risic
(74) *Attorney, Agent, or Firm* — Brian J. Colandreo; Jeffrey T. Placker; Holland & Knight LLP

(57) ABSTRACT

A multicomponent bridge support system includes: a base portion configured to make contact with bearing soil/strata/bedrock; a support portion configured to engage a bridge deck; and one or more precast intermediate portions configured to space the support portion with respect to the base portion.

24 Claims, 4 Drawing Sheets

BRIDGE SUPPORT SYSTEM

RELATED APPLICATION(S)

This application claims the benefit of U.S. Provisional Application No. 63/028,200, filed on 21 May 2020, the entire contents of which are incorporated herein by reference.

TECHNICAL FIELD

This disclosure relates to bridge support systems and, more particularly, to multicomponent prefabricated bridge support systems.

BACKGROUND

Bridge piers/abutments are common structures. The piers/abutments are the critical bearing component of a bridge that transfer bridge loads into the earth, examples of which may include but are not limited to: gravity loads (e.g., the weight of entire bridge superstructure and the weight of transported entities); and lateral loads (e.g., environmental loading from wind, seismic, and water pressure and from dynamic loading from load inertia, braking, and p-delta effects). Throughout history piers and abutments have been built with wood, stone, concrete, and numerous other materials or combinations thereof. Current practices in the construction of bridge piers/abutments may vary widely between private and public development. Private development (without regulation) may choose any of the materials or combinations mentioned above. Whereas municipal, state, and/or federally funded projects require the standardization and reliability of reinforced concrete piers/abutments in some manner of form, be it precast or cast-in-place. This process requires the engineering or design firm to determine the size and shape of the pier/abutment required to resist the load and load effects of the bridge against the type of the soil and environmental conditions the bridge support will bear on. The remaining part of the pier/abutment may then be designed for the overall height of the abutment, based on the depth needed to go into the earth and on the height desired as well as other factors (e.g., the seat to set the bridge beams on and a headwall to keep soil or other road material from collecting around the beams).

Typically, the different Department of Transportation engineers from state, federal, provincial, or even private sectors design piers/abutments with the use of cast-in-place concrete methods. This concrete mass will resist the load and load effects through its mass, strength, and controlled construction. The common design usually requires the installer to pour this mass of concrete in multiple placements as the pier/abutment design generally changes in shape from top to bottom. This process may be a multi-step process that can take weeks and months to complete based on the complexity of the pier/abutment design. One reason for the time needed is that the contractor is constructing these bridge substructures on site requiring continuous dewatering, formwork, reinforcing fabrication, inspections, and finally concrete placement. The next reason is that the contractor completes one layer of foundation work just to start over onto the next and they need to allow for a "cure" time for the previous placement before the next stage of work. This is the standard practice used in bridge building and is inherently a long construction process toward completion.

SUMMARY OF DISCLOSURE

In one implementation, a multicomponent bridge support system includes: a base portion configured to make contact with bearing soil/strata/bedrock; a support portion configured to engage a bridge deck; and one or more precast intermediate portions configured to space the support portion with respect to the base portion.

One or more of the following features may be included. The base portion may include one or more of: a precast base portion; and a poured base portion. The support portion may include one or more of: a precast support portion; and a poured support portion. The support portion may include one or more of: a neoprene pad assembly; and a bearing assembly. The support portion may be configured to engage one or more girder assemblies of the bridge deck. One or more of the portions may be configured to receive one or more pinning assemblies. The one or more pinning assemblies may include one or more of: a rebar assembly and a pipe assembly. The one or more pinning assemblies may be configured to be grouted within the one or more portions. The base portion may be configured to be pinned to the bearing soil/strata/bedrock. The multicomponent bridge support system may be configured to form a bridge abutment assembly. The multicomponent bridge support system may be configured to form a bridge pier assembly. A gasket assembly may be positioned between the one or more of the portions. At least a first of the portions may include one or more shear interlock protrusions. At least a second of the portions may include one or more shear interlock recesses configured to receive the shear interlock protrusions.

In another implementation, a multicomponent bridge support system includes: a base portion configured to make contact with bearing soil/strata/bedrock; a support portion configured to engage a bridge deck; and one or more precast intermediate portions configured to space the support portion with respect to the base portion; wherein the support portion is configured to engage one or more girder assemblies of the bridge deck One or more of the following features may be included. The base portion may include one or more of: a precast base portion; and a poured base portion. The support portion may include one or more of: a precast support portion; and a poured support portion. The support portion may include one or more of: a neoprene pad assembly; and a bearing assembly. At least a first of the portions may include one or more shear interlock protrusions. At least a second of the portions includes one or more shear interlock recesses configured to receive the shear interlock protrusions.

In another implementation, a multicomponent bridge support system includes: a base portion configured to make contact with bearing soil/strata/bedrock; a support portion configured to engage a bridge deck; and one or more precast intermediate portions configured to space the support portion with respect to the base portion; wherein the support portion is configured to engage one or more girder assemblies of the bridge deck; and wherein one or more of the portions are configured to receive one or more pinning assemblies.

One or more of the following features may be included. The one or more pinning assemblies may include one or more of: a rebar assembly and a pipe assembly. The one or more pinning assemblies may be configured to be grouted within the one or more portions. The base portion may be configured to be pinned to the bearing soil/strata/bedrock. The multicomponent bridge support system may be configured to form a bridge abutment assembly. The multicomponent bridge support system may be configured to form a bridge pier assembly.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1:
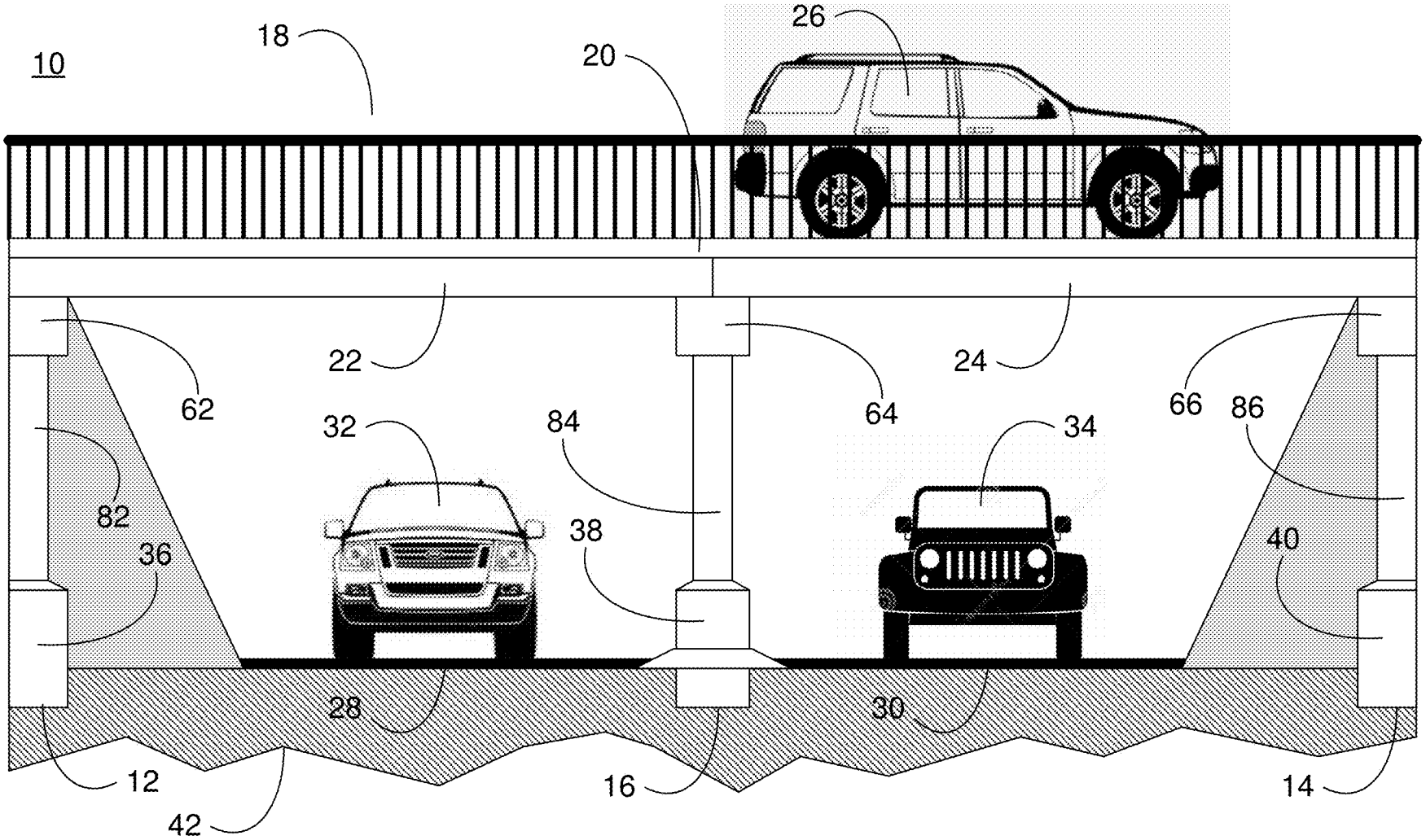
FIGS. 1-3 are diagrammatic views of a multicomponent bridge support system.
Figure 2:
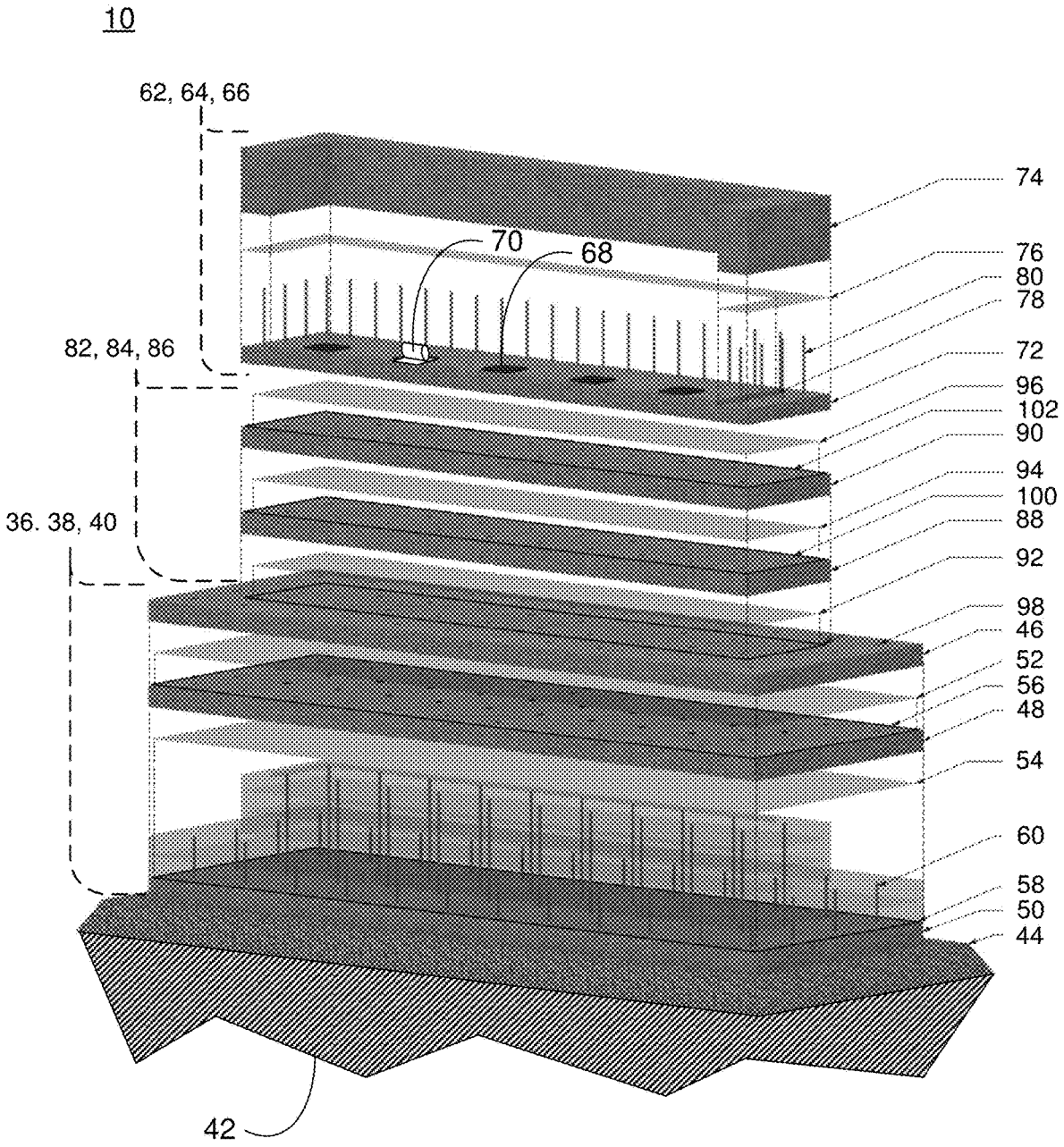
Figure 3:
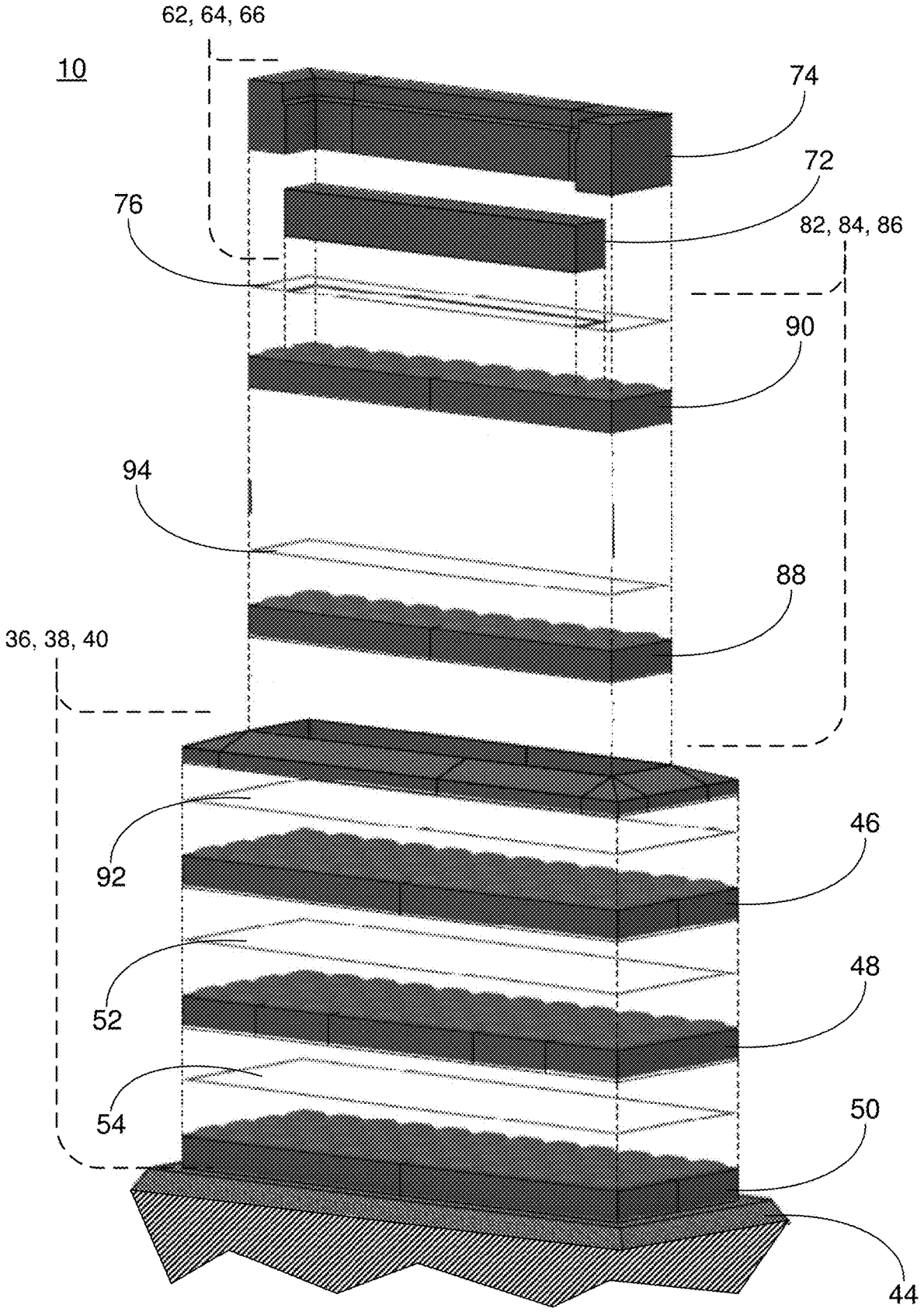

Referring to FIGS. 1-3, there is shown various views of multicomponent bridge support system 10. Multicomponent bridge support system 10 may be configured to form a bridge abutment assembly (e.g., bridge abutment assemblies 12, 14) and/or a bridge pier assembly (e.g., bridge pier assembly 16) of bridge assembly 18. As is known in the industry, a bridge abutment assembly (e.g., bridge abutment assemblies 12, 14) may be configured to support the distal ends of a bridge superstructure (e.g., bridge deck 20) generally and the ends of girder assemblies (e.g., girder assemblies 22. 24) specifically. As is known in the industry, a bridge pier assembly (e.g., bridge pier assembly 16) may be configured to support a bridge deck (e.g., bridge deck 20) intermediate span (e.g., midspan as depicted in FIG. 1) generally and girder assemblies (e.g., girder assemblies 22. 24) intermediate span (e.g., midspan as depicted in FIG. 1) specifically.

Generally speaking, the combination of two bridge abutment assemblies (e.g., bridge abutment assemblies 12, 14), with or without one or more bridge pier assemblies (e.g., bridge pier assembly 16) may form bridge assembly 18 that enables vehicle (e.g., vehicle 26), pedestrian, bicycle, animal or rail traffic (not shown) to pass over other obstructions or bodies, such as roadways 28, 30 (which contain vehicles 32, 34 respectively), rail line(s) (not shown), waterway(s) (not shown), etc.

Multicomponent bridge support system 10 may include a base portion (e.g., base portions 36, 38, 40) configured to make contact with bearing soil/strata/bedrock 42. The base portion (e.g., base portions 36, 38, 40) may include one or more of: a precast base portion; and a poured base portion. For example, these base portions (e.g., base portions 36, 38, 40) may be constructed offsite and transported to the worksite and placed e.g., directly onto bearing soil/strata/bedrock 42 or onto a compacted base (e.g., compacted gravel 44). Alternatively, these base portions (e.g., base portions 36, 38, 40) may be formed and poured in place in a fashion similar to traditional construction techniques.

In the event that these base portions (e.g., base portions 36, 38, 40) are constructed offsite and transported to the worksite and placed e.g., directly onto bearing soil/strata/bedrock 42 or onto a compacted base (e.g., compacted gravel base 44), these base portions (e.g., base portions 36, 38, 40) may be constructed in multiple portions/layers. For example and referring to FIGS. 2-3, these base portions (e.g., base portions 36, 38, 40) are shown to be constructed of (in this example) three layers (e.g., base portion layers 46, 48, 50). A gasket assembly (e.g., gasket assemblies 52, 54) may be positioned between these base portion layers. For example, gasket assembly 52 may be positioned upon upper surface 56 of base portion layer 48 and gasket assembly 54 may be positioned upon upper surface 58 of base portion layer 50, thus preventing/reducing the intrusion of water/contaminants between e.g., base portion layers 46, 48, 50.

Base portion layers 46, 48, 50 may be constructed as unitary layers (as shown in FIG. 2) or as multi-portion layers (as shown in FIG. 3). When these layers are constructed as multiple discrete portions (as shown in FIG. 3), these discrete portions may be of uniform size and may be configured to interlock with each other (e.g., such as in a running bond pattern), thus providing a higher level of strength (due to the interlocking configuration of the discrete portions) and easier transportability (due to the lighter weight/smaller size of these discrete portions). Any vertical seams between these discrete portions may be filled with an epoxy caulking.

These base portions (e.g., base portions 36, 38, 40) may be configured to be pinned to the bearing soil/strata/bedrock (e.g., bearing soil/strata/bedrock 42). For example, one or more pinning assemblies (e.g., pinning assemblies 60) may pass through passages in all or a portion of these base portions (e.g., base portions 36, 38, 40), thus penetrating these base portions (e.g., base portions 36, 38, 40) and pinning the same into (in this example) compacted gravel base 44 and/or bearing soil/strata/bedrock 42.

Examples of these pinning assemblies (e.g., pinning assemblies 60) may include one or more of: a rebar assembly (e.g., galvanized, corrosion resistant or coated lengths of rebar) and a pipe assembly (e.g., galvanized, corrosion resistant or coated lengths of pipe). These pinning assemblies (e.g., pinning assemblies 60) may be configured to be grouted within the one or more portions. For example, the passages within the base portions (e.g., base portions 36, 38, 40) through which pinning assemblies 60 may pass may be larger in diameter than the pinning assemblies themselves, thus forming a gap into which a hydraulic grout (e.g., cement-based hydraulic grout) may be inserted.

Multicomponent bridge support system 10 may include support portion (e.g., support portions 62, 64, 66) configured to engage a bridge deck (e.g., bridge deck 20) generally and engage one or more girder assemblies (e.g., girder assemblies 22. 24) of the bridge deck (e.g., bridge deck 20). The support portion (e.g., support portions 62, 64, 66) may include one or more of: neoprene pad assemblies (e.g., neoprene pad assembly 68 upon which girder assemblies 22, 24 may slide); and bearing assemblies (e.g., bearing assembly 70 upon which girder assemblies 22, 24 may roll).

The support portion (e.g., support portions 62, 64, 66) may include one or more of: a precast support portion components; and a poured support portion. For example, these support portion (e.g., support portions 62, 64, 66) may be constructed offsite (prefabricated) and transported to the worksite. Alternatively, these support portion components (e.g., support portions 62, 64, 66) may be formed and poured in place in a fashion similar to traditional construction techniques.

In the event that these support portions (e.g., support portions 62, 64, 66) are constructed offsite and transported to the worksite, these support portion components (e.g., support portions 62, 64, 66) may be constructed in multiple portions/layers. For example, these support portions (e.g., support portions 62, 64, 66) are shown to be constructed of (in this example) two layers (e.g., support portion layers 72, 74). For example, support portion layer 72 may be the support portion layer upon which neoprene pad assembly 68 and/or bearing assembly 70 may be positioned. Further, support portion layer 74 may be a headwall assembly to prevent dirt/backfill from contaminating neoprene pad assembly 68, bearing assembly 70 and/or girder assemblies 22, 24. A gasket assembly (e.g., gasket assembly 74) may be positioned between these portions. For example, gasket assembly 76 may be positioned upon upper surface 78 of support portion layer 72, thus preventing/reducing the intrusion of water/contaminants between e.g., support portion layers 72, 74.

Support portion layers 72, 74 may be constructed as unitary layers (as shown in FIG. 2) or as multi-portion layers (as shown in FIG. 3). When these layers are constructed as multiple discrete portions (as shown in FIG. 3), these discrete portions may be of uniform size and may be configured to interlock with each other (e.g., such as in a running bond pattern), thus providing a higher level of strength (due to the interlocking configuration of the discrete portions) and easier transportability (due to the lighter weight/smaller size of these discrete portions). Any vertical seams between these discrete portions may be filled with an epoxy caulking.

These portions (e.g., support portions 62, 64, 66) may be configured to be pinned to each other or other portions of multicomponent bridge support system 10. For example, one or more pinning assemblies (e.g., pinning assemblies 80) may pass through passages in all or a portion of these portions (e.g., support portions 62, 64, 66), thus penetrating these support portions (e.g., support portions 62, 64, 66) and pinning the same (in this example) together.

Examples of these pinning assemblies (e.g., pinning assemblies 80) may include one or more of: a rebar assembly (e.g., galvanized, corrosion resistant or coated lengths of rebar) and a pipe assembly (e.g., galvanized, corrosion resistant or coated lengths of pipe). These pinning assemblies (e.g., pinning assemblies 80) may be configured to be grouted within the one or more portions. For example, the passages within the support portions (e.g., support portions 62, 64, 66) through which pinning assemblies 80 may pass may be larger in diameter than the pinning assemblies themselves, thus forming a gap into which a hydraulic grout (e.g., cement-based hydraulic grout) may be inserted.

Multicomponent bridge support system 10 may include one or more precast intermediate portions (e.g., precast intermediate portions 82, 84, 86) configured to space the support portions (e.g., support portions 62, 64, 66 respectively) with respect to the base portions (e.g., base portions 36, 38, 40 respectively).

These precast intermediate portions (e.g., precast intermediate portions 82, 84, 86) may be constructed offsite and transported to the worksite and positioned to space support portions 62, 64, 66 (respectively) with respect to base portions 36, 38, 40 (respectively). Further, these precast intermediate portions (e.g., precast intermediate portions 82, 84, 86) may be constructed in multiple portions/layers. For example, these precast intermediate portions (e.g., precast intermediate portions 82, 84, 86) are shown to be constructed of (in this example) two layers (e.g., intermediate portion layers 88, 90). A gasket assembly (e.g., gasket assemblies 92, 94, 96) may be positioned between these portions. For example, gasket assembly 92 may be positioned upon upper surface 98 of base portion layer 46, gasket assembly 94 may be positioned upon upper surface 100 of intermediate portion layer 88 and gasket assembly 96 may be positioned upon upper surface 102 of intermediate portion layer 90, thus preventing/reducing the intrusion of water/contaminants between e.g., intermediate portion layer 88, 90, base portion layer 46, and support portion layer 72.

Intermediate portion layers 88, 90 may be constructed as unitary layers (as shown in FIG. 2) or as multi-portion layers (as shown in FIG. 3). When these layers are constructed as multiple discrete portions (as shown in FIG. 3), these discrete portions may be of uniform size and may be configured to interlock with each other (e.g., such as in a running bond pattern), thus providing a higher level of strength (due to the interlocking configuration of the discrete portions) and easier transportability (due to the lighter weight/smaller size of these discrete portions). Any vertical seams between these discrete portions may be filled with an epoxy caulking.

These portions (e.g., intermediate portions 82, 84, 86) may be configured to be pinned to each other or other portions of multicomponent bridge support system 10. For example, one or more pinning assemblies (e.g., pinning assemblies 60, 80) may pass through passages in all or a portion of these portions (e.g., intermediate portions 82, 84, 86), thus penetrating these intermediate portions (e.g., intermediate portions 82, 84, 86) and pinning the same (in this example) together and/or to base portions 36, 38, 40 and/or to support portions 62, 64, 66.

Examples of these pinning assemblies (e.g., pinning assemblies 60, 80) may include one or more of: a rebar assembly (e.g., galvanized, corrosion resistant or coated lengths of rebar) and a pipe assembly (e.g., galvanized, corrosion resistant or coated lengths of pipe). These pinning assemblies (e.g., pinning assemblies 60, 80) may be configured to be grouted within the one or more portions. For example, the passages within the intermediate portions 82, 84, 86 through which pinning assemblies 60, 80 may pass may be larger in diameter than the pinning assemblies themselves, thus forming a gap into which a hydraulic grout (e.g., cement-based hydraulic grout) may be inserted.

As discussed above, multicomponent bridge support system 10 may be constructed of intermediate portions (e.g., intermediate portions 82, 84, 86), support portions (e.g., support portions 62, 64, 66) and base portions (e.g., base portions 36, 38, 40). Further, each of these intermediate portions (e.g., intermediate portions 82, 84, 86), support portions (e.g., support portions 62, 64, 66) and base portions (e.g., base portions 36, 38, 40) may be constructed of multiple layers.

For example, the intermediate portions (e.g., intermediate portions 82, 84, 86) are discussed above as being constructed of intermediate portion layers 88, 90, which may be unitary or multi-portion. Further, the support portions (e.g., support portions 62, 64, 66) are discussed above as being constructed of support portion layers 72, 74, which may be unitary or multi-portion. Additionally, the base portions (e.g., base portions 36, 38, 40) are discussed above as being constructed of base portion layers 46, 48, 50, which may be unitary or multi-portion.

Figure 4:
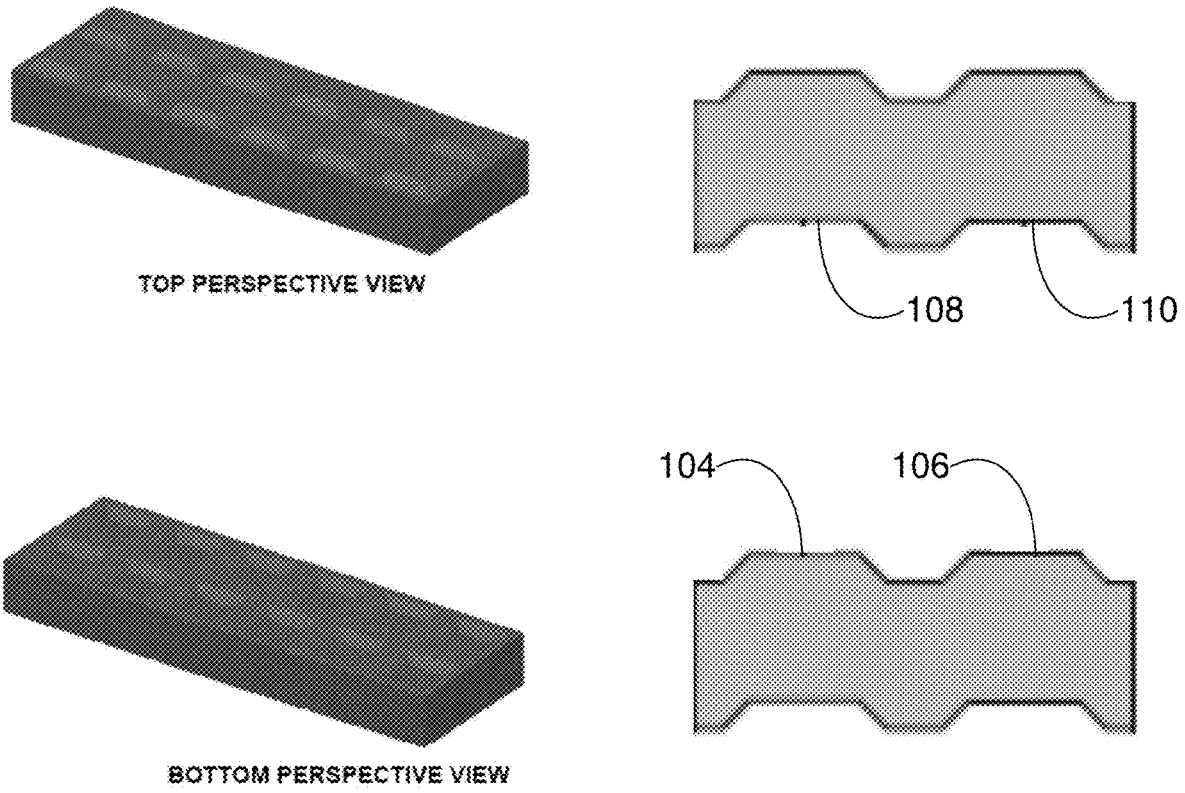
FIG. 4 is a detail view of shear interlock protrusions and shear interlock recesses included within the multicomponent bridge support system of FIG. 1.

Referring also to FIG. 4 and in order to ensure that these portions and/or layers are properly secured to each other (e.g., to prevent them from sliding with respect to each other), at least a first of the portions (and/or the layers from which they are constructed) may include one or more shear interlock protrusions (e.g., shear interlock protrusions 104, 106) and at least a second of the portions (and/or the layers from which they are constructed) may include one or more shear interlock recesses (e.g., shear interlock recesses 108, 110) configured to receive the shear interlock protrusions (e.g., shear interlock protrusions 104, 106), thus allowing these portions and/or layers to be rigidly positioned with respect to each other (in a fashion similar to children's building blocks).

General:

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

A number of implementations have been described. Having thus described the disclosure of the present application in detail and by reference to embodiments thereof, it will be apparent that modifications and variations are possible without departing from the scope of the disclosure defined in the appended claims.

What is claimed is:

1. A multicomponent bridge support system comprising:
- a base portion configured to make contact with bearing soil/strata/bedrock;
- a support portion configured to engage a bridge deck, wherein the support portion includes one or more of a neoprene pad assembly and a bearing assembly upon which at least a portion of the bridge deck can roll; and
- one or more precast intermediate portions configured to space the support portion with respect to the base portion.

2. The multicomponent bridge support system of claim 1 wherein the base portion includes one or more of:
- a precast base portion; and
- a poured base portion.

3. The multicomponent bridge support system of claim 1 wherein the support portion includes one or more of:
- a precast support portion; and
- a poured support portion.

4. The multicomponent bridge support system of claim 1 wherein the support portion is configured to engage one or more girder assemblies of the bridge deck.

5. The multicomponent bridge support system of claim 1 wherein one or more of the portions are configured to receive one or more pinning assemblies.

6. The multicomponent bridge support system of claim 5 wherein the one or more pinning assemblies include one or more of:
- a rebar assembly and
- a pipe assembly.

7. The multicomponent bridge support system of claim 5 wherein the one or more pinning assemblies are configured to be grouted within the one or more portions.

8. The multicomponent bridge support system of claim 1 wherein the base portion is configured to be pinned to the bearing soil/strata/bedrock.

9. The multicomponent bridge support system of claim 1 wherein the multicomponent bridge support system is configured to form a bridge abutment assembly.

10. The multicomponent bridge support system of claim 1 wherein the multicomponent bridge support system is configured to form a bridge pier assembly.

11. The multicomponent bridge support system of claim 1 further comprising:
- a gasket assembly positioned between the one or more of the portions.

12. The multicomponent bridge support system of claim 1 wherein at least a first of the portions includes one or more shear interlock protrusions.

13. The multicomponent bridge support system of claim 12 wherein at least a second of the portions includes one or more shear interlock recesses configured to receive the shear interlock protrusions.

14. A multicomponent bridge support system comprising:
- a base portion configured to make contact with bearing soil/strata/bedrock;
- a support portion configured to engage a bridge deck; and
  - one or more precast intermediate portions configured to space the support portion with respect to the base portion;
  - wherein the support portion is configured to engage one or more girder assemblies of the bridge deck, and wherein the support portion includes one or more of a neoprene pad assembly and a bearing assembly upon which one or more girder assemblies can roll.

15. The multicomponent bridge support system of claim 14 wherein the base portion includes one or more of:
- a precast base portion; and
- a poured base portion.

16. The multicomponent bridge support system of claim 14 wherein the support portion includes one or more of:
- a precast support portion; and
- a poured support portion.

17. The multicomponent bridge support system of claim 14 wherein at least a first of the portions includes one or more shear interlock protrusions.

18. The multicomponent bridge support system of claim 17 wherein at least a second of the portions includes one or more shear interlock recesses configured to receive the shear interlock protrusions.

19. A multicomponent bridge support system comprising:
- a base portion configured to make contact with bearing soil/strata/bedrock;
- a support portion configured to engage a bridge deck; and
- one or more precast intermediate portions configured to space the support portion with respect to the base portion;
- wherein the support portion is configured to engage one or more girder assemblies of the bridge deck, and wherein the support portion includes one or more of a neoprene pad assembly and a bearing assembly upon which one or more girder assemblies can roll; and
- wherein one or more of the portions are configured to receive one or more pinning assemblies.

20. The multicomponent bridge support system of claim 19 wherein the one or more pinning assemblies include one or more of:

a rebar assembly and a pipe assembly.

21. The multicomponent bridge support system of claim 19 wherein the one or more pinning assemblies are configured to be grouted within the one or more portions.

22. The multicomponent bridge support system of claim 19 wherein the base portion is configured to be pinned to the bearing soil/strata/bedrock.

23. The multicomponent bridge support system of claim 19 wherein the multicomponent bridge support system is configured to form a bridge abutment assembly.

24. The multicomponent bridge support system of claim 19 wherein the multicomponent bridge support system is configured to form a bridge pier assembly.

* * * * *